United States Patent [19]

Cuntze et al.

[11] 4,102,793

[45] Jul. 25, 1978

[54] HEAT-RESISTANT FIBER CONDITIONING AGENTS

[75] Inventors: Ulrich Cuntze, Hofheim, Taunus; Gustav Dollinger, Egelsbach; Rolf Kleber, Neu-Isenburg; Hans-Jerg Kleiner, Kronberg, Taunus, all of Fed. Rep. of Germany

[73] Assignee: Hoechst Aktiengesellschaft, Frankfurt am Main, Fed. Rep. of Germany

[21] Appl. No.: 678,700

[22] Filed: Apr. 20, 1976

[30] Foreign Application Priority Data

Apr. 24, 1975 [DE] Fed. Rep. of Germany ..... 2518124

[51] Int. Cl.$^2$ ..... C09K 3/28

[52] U.S. Cl. ..... 252/8.1; 106/15 FP; 428/921

[58] Field of Search ..... 252/8.1; 106/15 FP; 117/136; 428/921

[56] References Cited

U.S. PATENT DOCUMENTS

| | | | |
|---|---|---|---|
| 3,846,482 | 11/1974 | Kerst | 252/8.1 X |
| 3,846,483 | 11/1974 | Kerst | 252/8.1 X |
| 3,940,436 | 2/1976 | Kerst | 252/8.1 X |
| 3,958,061 | 5/1976 | Singer et al. | 252/8.1 X |

*Primary Examiner*—Stephen J. Lechert, Jr.
*Attorney, Agent, or Firm*—Connolly and Hutz

[57] ABSTRACT

A process for the conditioning of synthetic fibers, which comprises applying onto these fibers mixtures of alkane-phosphonic acid salts and alkane-phosphonic acid-semi-ester salts in a molar ratio of from 19:1 to 5:1.

1 Claim, 1 Drawing Figure

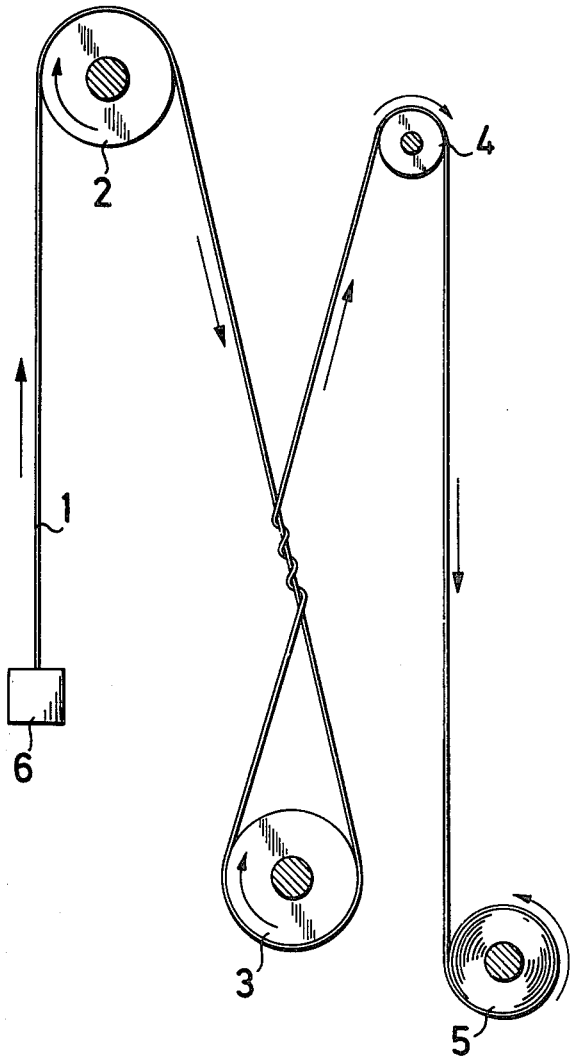
2
4
1
6
3
5

HEAT-RESISTANT FIBER CONDITIONING AGENTS

The present invention relates to heat-resistant fiber conditioning agents.

Synthetic fibers, among which there are to be mentioned endless filaments as well as staple fibers, require in the process of their preparation a composition, the purpose of which it is to prevent or reduce an electrostatic charge, and to control the sliding properties, i.e. the sliding friction between filament and metal (dynamic friction) and the adhesive friction between filament and filament (static friction). In this process it must be ensured, however, that these fiber conditioning agents applied in the fiber preparation can be eliminated again without difficulty from the fiber in the following fiber processing phase, either before the dyeing or in the finishing of the finished products, or that said agents do not adversely affect the dyeing or finishing processes.

It is another important requirement for the technical use of conditioning agents that these compositions must be thermostable, i.e. stable at high temperatures. This is particularly important, as synthetic fibers are more and more subjected, in the course of their manufacture, to a heat treatment, and are again put under the stress of high temperatures in the following textile processing.

It has already been known that esters of orthophosphoric acid are good antistatic agents. It is these products, however, which generally show a high dynamic fiber-metal friction and an insufficient thermal stability, so that they have turned out not to be the optimum products for use in the fiber conditioning.

Moreover, the mixtures of mono- and diesters of phosphoric acid known for this purpose have the drawback that they are present in the form of hard waxes, and that they can only be brought into their form of application by being boiled with water.

In order to avoid these drawbacks of phosphoric acid esters, use has been made of the semi-ester salts of organic acids (German Offenlegungsschrift No. 2,256,735). It became evident, however, that in spite of the favorable effects in view of their application, these semi-ester salts of phosphonic acids can only be obtained with difficulty, and that the effects with regard to their application cannot always be reproduced, due to the complicated process of their manufacture.

Tests regarding the use of pure phosphonic acids or the salts thereof have shown that satisfactory antistatic and/or sliding properties cannot be obtained.

It has now been found that anionic compounds having good antistatic effects, which may be used as liquid formulations and which show a high thermostability and impart to synthetic fibers the desired low dynamic and static friction, can be obtained, if a mixture of a phosphonic acid salt of the formula I

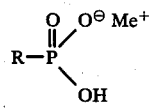

I and of a
phosphonic acid-semi-ester of the formula II

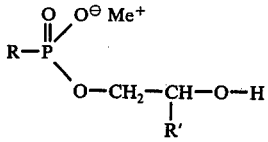

II is used in a molar ratio of from 19:1 to 5:1.

In these formulae R represents a saturated unbranched alkyl radical having from 6 to 12 carbon atoms, preferably 8 carbon atoms, R′ stands for hydrogen or methyl, preferably hydrogen, and $Me^+$ is an alkali cation of Li, Na or K, preferably Na.

These mixtures are prepared by reacting an alkane-phosphonic acid of the formula III

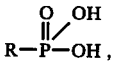

III in which R is defined as above, with from 0.05 to 0.2 mole of ethylene oxide and/or propylene oxide, at a temperature in the range of from 120° to 180° C, preferably from 130° to 160° C, and by neutralizing the reaction mixture subsequently with alkali metal hydroxide in water to a pH value of from 6 to 8.

The alkane-phosphonic acids of the formula III are obtained by way of a known process by high-temperature hydrolysis of alkane-phosphonic acid-dialkylesters which are prepared by the addition of olefins to dialkylphosphites according to German Offenlegungsschrift No. 1,963,014.

In the course of this process it became evident that only those compounds, in which the degree of alkoxylation is in the range of from 0.05 to 0.2 mole per mole of alkane-phosphonic acid, show the desired properties with regard to their application. Thus, the non-neutralized alkane-phosphonic acids of the chain length indicated above have only a minor water-solubility with moderate antistatic values. Also the mono- or dialkali metal salts of these alkane-phosphonic acids only show moderate antistatic values. Those products, in which the degree of alkoxylation per mole of alkane-phosphonic acid is higher than 0.2, are in fact heat-resistant and have favorable antistatic values, however, the friction coefficients with regard to dynamic as well as to static friction are too high in order to yield compositions showing suitable properties as to their application.

The above-mentioned compounds are applied onto synthetic fibers, such as polyester, polyamide and polyacrylonitrile, but also onto polyolefins. In order to obtain favorable sliding properties, coating amounts of from 0.1 to 2%, preferably from 0.3 to 1.0%, are sufficient, the compounds optionally being used by themselves or in admixture with known conditioning agents, such as lubricant components and agents for effecting a compactness of the thread.

The following Examples serve to illustrate the invention.

EXAMPLE 1

4.4 Grams of ethylene oxide were introduced into 194 g (1 mole) of n-octane-phosphonic acid at 150° C. After 5 minutes the absorption of ethylene oxide was completed, and the pH value of the product in 290 ccm of water was adjusted to 7.0 with 108 g of sodium hydroxide solution of 33% strength. 595 Grams of an aqueous solution of 40% strength of a mixture of

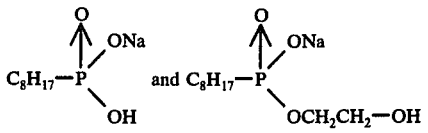

in a molar ratio of 9:1 were obtained.

EXAMPLE 2

At a temperature of 140° C, 4.8 g of ethylene oxide were introduced into 166 g (1 mole) of n-hexane-phosphonic acid. Subsequently the reaction product was neutralized in 202 ccm of water with 107 g of sodium hydroxide solution of 33% strength. 480 g of an aqueous solution containing 43% of active ingredient were obtained, which ingredient consisted of a mixture of

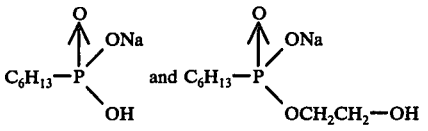

in a molar ratio of 10:1.

EXAMPLE 3

At a temperature of 160° C, 5 g of ethylene oxide were introduced into 222 g (1 mole) of n-decane-phosphonic acid. Subsequently the reaction product was neutralized in 539 ccm of water with 106 g of sodium hydroxide solution of 33% strength. 870 Grams of an aqueous solution containing 30% of active ingredient were obtained, which ingredient consisted of a mixture of

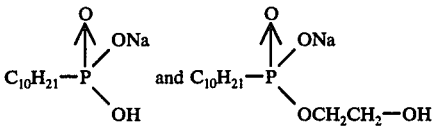

in a molar ratio of 11:1.

The better effect of the products of the present invention can be seen from the following comparative tests:

Comparative Test I

The following compounds were compared with one another:

(1) Octane-phosphonic acid (German Patent Specification No. 1,207,759, Example 1*b*).
(2) Octane-phosphonic acid-monosodium salt.
(3) A 1:1 mixture of mono- and dilaurylphosphate-Na salts (British Patent Specification No. 999,199, column 3, line 70).
(4) A mixture of octane-phosphonic acid-monosodium salt and octane-phosphonic acid-monohydroxyethylester-sodium salt in a molar ratio of 9:1 (according to Example 1of the invention), as an aqueous solution of 40% strength.
(5) A mixture of octane-phosphonic acid-monosodium salt and octane-phosphonic acid-monohydroxyethylester-sodium salt in a molar ratio of 2:1, as an aqueous solution of 45% strength.

Solubility:

The compounds showed the following solubility in water (25° C):

(1) White powder, hardly soluble in water (<1%);
(2) white powder, soluble in water;
(3) a paste of a hard wax consistency which was only soluble in water after boiling; an aqueous solution of more than 10% strength showed a precipitate after 1 hour;
(4) clearly soluble in water (100%), yielded stable solutions having a solid matter content of up to 70%;
(5) same as 4.

Thermostability:

The products (1 g) were heated for 1 hour at 220° C, and the loss by evaporation was determined gravimetrically.

The following losses of active substance were found:

(1) 2%
(2) 1.5%
(3) 41%
(4) 3%
(5) 10%.

Dynamic and Static Friction:

The compounds 1 to 5 were applied, by means of a processing lick roller, from aqueous solutions onto a polyamide 6-filament (dtex 220 f 32), with a coating of about 0.7%, and were dried at 80° C. The filaments thus prepared were tested for their sliding and adhesive friction (dynamic and static friction). In the course of this process, the following values were obtained:

| | Sliding friction (dynamic friction) | Adhesive friction (static friction) |
|---|---|---|
| (1) | 0.26 to 0.33 | 4.0 |
| (2) | 0.28 to 0.35 | 3.0 |
| (3) | 0.25 to 0.32 | 1.0 |
| (4) | 0.24 to 0.31 | 3.5 |
| (5) | 0.30 to 0.41 | 14.0 |

The measurement of the dynamic friction was carried out by way of the device described in German Offenlegungsschrift No. 2,335,675.

The static friction was determined by means of the measuring apparatus illustrated diagrammatically in the accompanying drawing:

In this apparatus, the filament 1 to be measured is passed over rolls 2 and 3 to a measuring head 4 and then to a take-up roll 5, the filament passing from the roll 3 to the measuring head 4 being wound three times around the filament passing from roll 2 to roll 3. The free end of the filament is tensioned with a counter weight 6 of 13 g and the take-up roll is adjusted to a filament running speed of 20 cm/hour. The frictional resistance occurring at the places where the filaments are in contact is determined by means of the measuring head by the differences in the filament tension and expressed in scale sections (which are proportional to these differences of tension).

Antistatic Properties

The antistatic values of the finished polyamide 6-filaments were determined after the products had been subjected to a 24-hour air conditioning at a relative humidity of 65% and a temperature of 22° C, said values being expressed by the surface resistance in Meg-Ohm.

(1) 100,000
(2) 11,000
(3) 25
(4) 20
(5) 20.

Comparative Test II

A polyester flock (1.4 dtex; length of cut: 38 mm) was freed from its preparation by extraction with methanol and after drying was treated with the following aqueous solutions (with a coating of 0.2% of the active ingredient of the following products) and then dried. The flock was tested for its sliding properties on a card, after opening and after winding.

(1) A mixture of

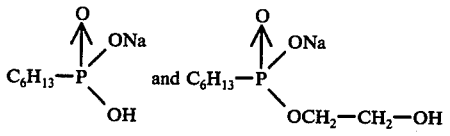

In a molar ratio of 10:1 (according to Example 2 of the present Application).

(2) A mixture of

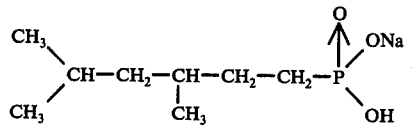

and

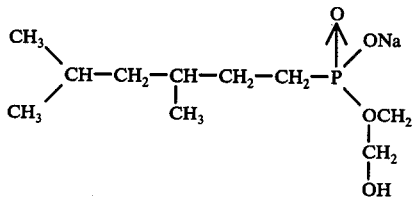

in a molar ratio of 9:1.

(3)

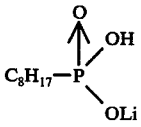

(4) A mixture of

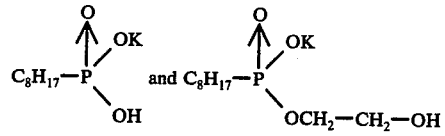

in a molar ratio of 2:1.

(5) A mixture of

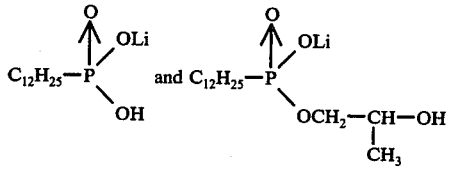

in a molar ratio of 9:1 (according to this Application).

(6) A mixture of

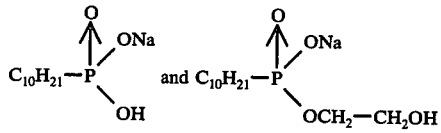

in a molar ratio of 11:1 (according to Example 3 of the present Application).

It is only the fibers treated according to the present invention which show satisfactory sliding properties on a card, without being caught on the needles or showing burls in the sliver.

We claim:

1. Aqueous mixtures containing an alkane-phosphonic acid salt of the formula I

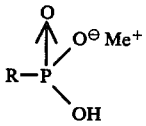

I and an alkane-phosphonic acid-semi-ester salt of the formula II

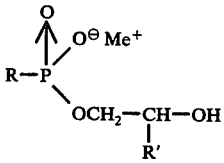

II in a molar ratio of from 19:1 to 5:1, R being an unbranched saturated alkyl radical having from 6 to 12 carbon atoms, R′ being hydrogen or methyl, and $Me^+$ standing for Li, Na or K.

* * * * *